United States Patent [19]

Stirbis

[11] Patent Number: 4,953,738

[45] Date of Patent: Sep. 4, 1990

[54] ONE PIECE CAN BODY WITH DOMED BOTTOM

[76] Inventor: James S. Stirbis, 5451 S. Federal Cir., Apt. D-106, Littleton, Colo. 80123

[21] Appl. No.: 157,804

[22] Filed: Feb. 19, 1988

[51] Int. Cl.[5] ..... B65D 8/12; B65D 6/38

[52] U.S. Cl. ..... 220/606; 220/906

[58] Field of Search ..... 270/66, 70, 72, 1 BC; D9/397, 398

[56] References Cited

U.S. PATENT DOCUMENTS

| | | | |
|---|---|---|---|
| 6,391 | 4/1875 | Scaife | 220/72 |
| 77,280 | 4/1868 | Hadden | 220/72 |
| 204,971 | 6/1878 | Hill | 220/66 |
| D.209,714 | 12/1967 | Evans | D9/398 |
| D.290,688 | 7/1987 | Moloney et al. | D9/398 |
| 423,833 | 3/1890 | Stiveson et al. | 220/72 |
| 1,047,652 | 12/1912 | Killion | 220/66 X |
| 1,963,795 | 6/1934 | Lang | 220/66 |
| 2,005,641 | 6/1935 | Stanitz et al. | 220/72 |
| 2,063,013 | 12/1936 | Cooper | 220/72 |
| 2,527,085 | 10/1950 | Snow | 220/72 X |
| 3,029,507 | 4/1962 | Geggini | 29/534 |
| 3,142,409 | 7/1964 | Ross . | |
| 3,189,214 | 6/1965 | Hendert . | |
| 3,232,260 | 2/1966 | Sievronsen | 220/ |
| 3,272,383 | 9/1966 | Harvey | 220/66 |
| 3,335,902 | 8/1967 | Janorik | 220/72 |
| 3,349,956 | 10/1967 | Stephen | 220/ |
| 3,355,060 | 11/1967 | Reynolds et al. | 220/ |
| 3,360,158 | 12/1967 | Klein | 220/66 |
| 3,409,167 | 11/1968 | Blanchard | 220/66 |
| 3,416,702 | 12/1968 | Hoenig | 220/70 |
| 3,423,965 | 1/1969 | Stolle et al. . | |
| 3,572,271 | 3/1971 | Fraze . | |
| 3,690,507 | 9/1972 | Gailus et al. | 220/66 |
| 3,693,828 | 9/1972 | Kneusel et al. | 220/70 X |
| 3,730,383 | 5/1973 | Dunn et al. | 220/66 |
| 3,731,838 | 5/1973 | Gedde | 220/67 |
| 3,904,069 | 9/1975 | Toulemanian | 220/66 |
| 3,905,109 | 10/1975 | Essex, Jr. et al. | 220/66 |
| 3,905,507 | 9/1975 | Lyu | 220/66 |
| 3,979,009 | 9/1976 | Walker | 220/66 |
| 4,120,419 | 10/1978 | Saunders | 220/66 |
| 4,134,510 | 1/1979 | Chang | 220/70 X |
| 4,147,271 | 4/1979 | Yamaguchi | 220/70 |
| 4,222,494 | 9/1980 | Lee, Jr. et al. | 220/66 |
| 4,294,373 | 10/1981 | Miller et al. | 220/70 |
| 4,412,627 | 11/1983 | Houghton et al. | 220/66 |
| 4,646,930 | 3/1987 | Karas et al. | 220/70 |
| 4,685,582 | 8/1987 | Pulcrenl et al. | 220/66 |
| 4,723,681 | 2/1988 | Glerum | 220/72 |
| 4,732,292 | 3/1988 | Supik | 220/72 X |
| 4,834,256 | 5/1989 | McMillin | 220/66 |

*Primary Examiner*—Bryon P. Gehman

*Attorney, Agent, or Firm*—Klaas & Law

[57] ABSTRACT

A one-piece metallic can body member comprising a cylindrical relatively thin side wall portion; an open end rim portion; a dome-shape bottom wall portion having a concave dome-shape central portion, a convex axially outwardly extending lowermost annular support rib portion connected to the dome-shape central portion, and a radially outmost inclined connecting wall portion which extends between the side wall portion and the lowermost annular support rib portion. A plurality of circumferentially spaced radially inwardly extending convex groove-rib portions in the concave dome-shape central portion extend radially inwardly from the lowermost annular support rib portion. An annular convex groove-rib portion is located in the concave dome-shape central portion and intersects the radially inwardly extending convex groove-rib portions.

36 Claims, 86 Drawing Sheets

ONE PIECE CAN BODY WITH DOMED BOTTOM

This invention relates to a one-piece can body member made of metallic material such as aluminum or steel, and more particularly to a one-piece body having rib and groove reinforcement structure for a domed bottom wall portion and/or a cylindrical side wall portion.

BACKGROUND OF INVENTION

At the present time, two-piece can-type containers are widely used for beverages such as beer and soft drinks. A two-piece can container comprises a drawn and ironed one-piece can body member and a one-piece end or lid member having an easy-open device mounted thereon. The can body member has a cylindrical side wall portion, a bottom wall portion and an open end necked and flanged rim wall portion for attachment of the end member after filling of the can body member. The bottom wall portion has a convex annular lowermost reduced diameter support rib portion circumjacent a dome-shape axially inwardly extending concave central panel portion to provide sufficient strength to enable use of less costly thinner gauge sheet material for the can body member. Relatively small reductions in the size and gauge of the sheet material result in very substantial cost of material savings when billions of cans are involved.

A typical aluminum can body member of current design is made from 0.012 inch thickness aluminum alloy sheet material and has a reduced thin side wall portion of approximately 0.004 inch thickness. The bottom wall portion is approximately 0.012 inch thick and is connected to the thin side wall portion by a tapered transition wall portion. The upper rim wall portion is approximately 0.006 to 0.007 inch thick to enable seaming (attaching) of the lid and is connected to the thin side wall portion by a tapered transition wall portion.

Some of the limitations on size and gauge of the sheet material are that the can body member must provide (1) a predetermined volume (e.g. 12 ounces); (2) sufficient strength to enable high speed manufacturing operations such as trimming and necking and flanging of the rim portion, decoration, internal coating, filling and attachment of the end member by seaming; (3) sufficient side wall strength to prevent damage during handling, manufacturing, filling, transportation, storage and use; and (4) structural integrity such as to prevent leakage and deformation when filled with carbonized beverages.

While the use of a domed bottom wall structure enables reduction of the can bottom wall thickness, such structure also reduces volume so that can height may have to be increased. Reductions in depth of the domed bottom wall structure are advantageous so as to increase volume and reduce can height. However, the domed bottom wall structure must have sufficient strength and structural integrity to prevent bulging and reversal under pressure which may exceed 100 psi with carbonated beverages subject to relatively high temperatures and agitation.

A can body member must be designed to withstand a certain maximum inside pressure and to provide a certain minimum column strength to prevent buckling under axial loads during shipping and handling. If the side wall portion is too thin, the cans at the bottom of a vertical stack of cans, such as on a pallet, may buckle. Typically, the selected wall thickness is more than is required for internal pressure requirements in order to prevent buckling.

Can failure due to internal pressure occurs most often at the bottom wall portion when the "dome" reverses. If the dome wall portion is made of too thin material, the dome portion will deform downwardly under internal pressure and the can will rock if placed on a flat surface, such as a table. Normal internal pressure is caused by carbonation in the beverage and/or heat of pasteurization. In use, the internal pressure may be greatly increased when the beverage is subject to high atmospheric temperature and/or agitation. Most can designs also make the dome side wall almost vertical to enhance dome strength and the circumjacent convex support rib has a diameter smaller than the can side wall diameter in order to enable stacking of one can on top of another can.

SUMMARY OF INVENTION

The present invention provides both an improved domed bottom wall structure an improved side wall structure which may be used separately or in combination.

In general, both the improved bottom wall structure and the improved side wall structure comprise the formation of shallow-depth groove-rib means portions in a particular pattern and in particular locations in the bottom wall portion and in the side wall portion of the can body member during formation of the can body member by a draw and ironing process in a conventional can body making machine having appropriate tooling for formation of the groove-rib means structure of the present invention. The shallow-depth groove-rib means are formed by lateral displacement and deformation of the sheet material a relatively short distance which is preferably not greater than the thickness of the adjoining side wall portions for the side wall rib-groove structure and approximately twice the thickness of the adjoining bottom wall portions for the bottom wall rib-groove structure. In addition, the shallow-depth groove-rib means have curved concave or convex cross-sectional configurations of relatively large radius including reversely curved wall connecting portions of relatively large radius.

The improved side wall structure of the can body member comprises a plurality of relatively narrow width circumferentially spaced concave shallow groove-rib portions extending axially between upper and lower circumferential extending annular concave shallow groove-rib portions. The circumferentially spaced axially extending groove-rib portions are provided to increase column strength. The lower annular groove-rib portion is provided to reduce denting in the lowermost side wall portion. The upper annular groove-rib portion is provided to prevent deformation and maintain concentricity of the rim portion during can handling and manufacturing processing prior to filling and seaming of the can end member.

The improved domed bottom wall structure of the can body member comprises groove-rib structure pattern in the bottom wall portion to enable reduction in wall thickness and in depth of the dome portion resulting in reduction in can height while maintaining sufficient strength to prevent deformation. The groove-rib bottom wall structure pattern comprises a plurality of circumferentially spaced radially inwardly extending convex rib-groove portions and an intersecting annular convex rib-groove portion in the central dome portion of the bottom wall structure. The groove-rib bottom wall structure pattern may further comprise a plurality of circumferentially spaced concave groove-rib portions in the connecting wall portion between the convex support rib portion and the side wall portion.

BRIEF DESCRIPTION OF DRAWINGS

Illustrative and presently preferred embodiments of the invention are shown in the accompanying drawings wherein.

DETAILED DESCRIPTION

Figure 1:
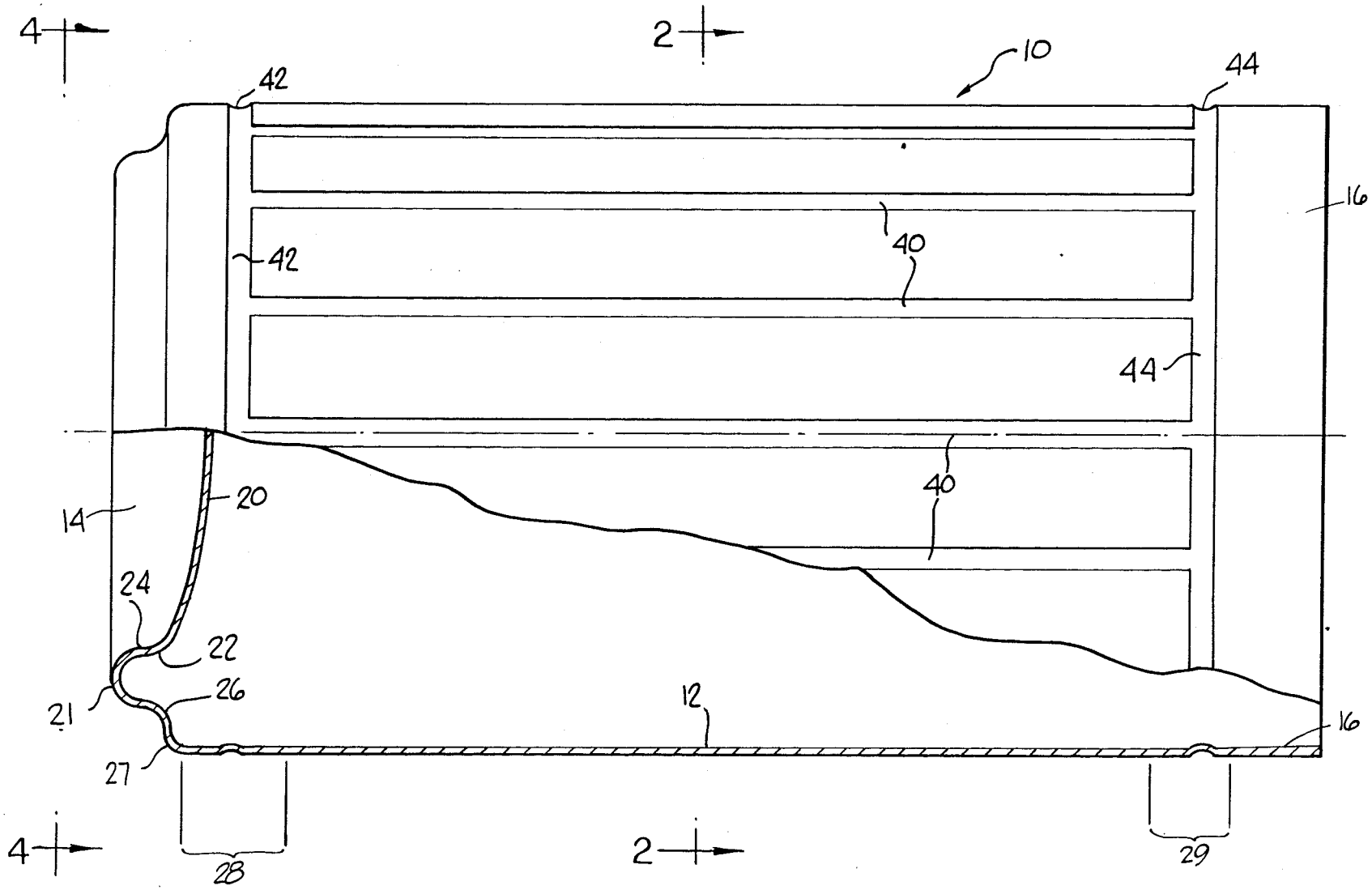
FIG. 1 is a side elevational view, partly in cross-section of a can body member having an improved side wall structure.
Figure 2:
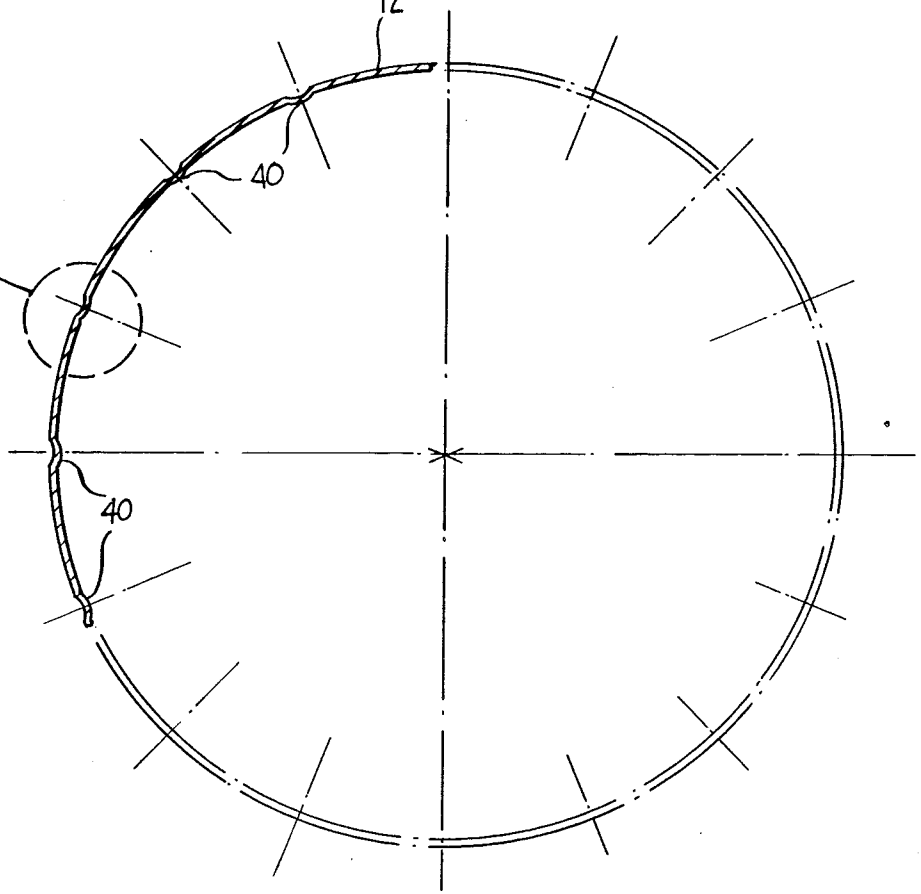
FIG. 2 is a partial cross-sectional view of the can body member of FIG. 1
Figure 3:
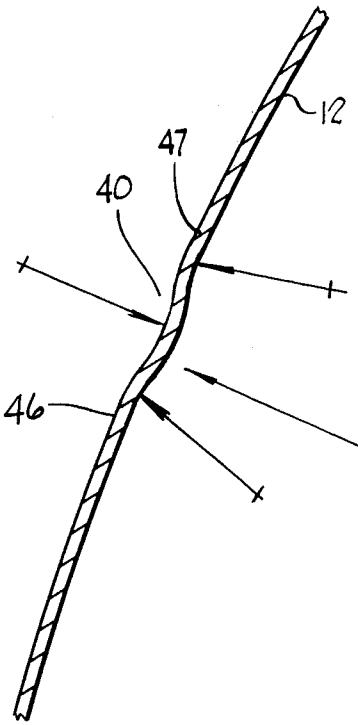
FIG. 3 is an enlarged partial cross-sectional view of an axial groove-rib portion of the can body member.

FIGS. 1—3 show a one-piece aluminum can body member 10 comprising a cylindrical thin side wall portion 12, a conventional domed-shape bottom wall portion 14, and an open rim portion 16 which is subsequently necked and flanged to enable attachment of an end member after filling of the can with a beverage such as beer or a soft drink or the like.

The bottom wall portion 14 comprises a central axially inwardly extending concave dome-shape central panel portion 20 connected to an annular convex bottommost support rib portion 21 by a curved portion 22 and an axially inwardly extending annular side wall portion 24. Convex support rib portion 21 is connected to side wall portion 12 by an intermediate radially inwardly extending concave annular rib portion 26, and a curved annular side wall connecting portion 27 which enable vertical stacking of similar size and shape cans. The bottom wall portion 14 is of greater thickness (e.g. approximately 0.012 inch) than the thin side wall portion 12 (e.g. approximately 0.004 inch) and is connected thereto by a tapered-thickness transition end wall portion 28. In addition, the rim portion 16 is of greater thickness (e.g. approximately 0.006 to 0.007 inch) than the side wall portion 12 and is connected thereto by a tapered-thickness transition wall portion 29.

The side wall portion 12 has a plurality of circumferentially spaced radially inwardly extending parallel concave groove-rib portions 40 extending axially between radially inwardly extending annular concave groove-rib portions 42, 44. In the presently preferred embodiment, there are 16 shallow-depth groove-rib portions 40 which are of relatively narrow width and equal size and shape and equally circumferentially spaced. The groove-rib portions 40, 42, 44 have curved concave cross-sectional wall portions 45, FIG. 3, which are inwardly offset from the side wall portion 12 a relatively short maximum distance, e.g. approximately 0.004 inch, and are connected thereto by reversely curved connecting wall portions 46, 47. The thickness of the groove-rib portions 40, 42, 44 will be substantially the same (e.g. approximately 0.004 inch) as the thickness of the side wall portions in which they are formed. The groove-rib wall portions 45, 46, 47 have relatively large radii of curvature of approximately 0.02 inch, and the groove-rib portions have a relatively narrow width of approximately 0.1 inch.

The axial rib portions 40 extend parallel to the central can axis to increase column strength to prevent buckling. An advantage of radially inwardly offset concave, as opposed to outwardly offset convex, rib portions is that there is no abrasion during shipping and handling and the cans may be processed in the usual manner with conventional equipment, such as necker-flanger, decorator and coater machines and the like.

The lower annular rib portion 42 increases strength to prevent denting of the can during manufacture, shipping and handling. The upper annular rib portion 44 is to prevent elastic deformation of the rim portion 16 during manufacture when cans are conveyed at high speed which can cause the circular cross-sectional configuration to become oval and cause loading and forming problems in various can manufacturing equipment.

Figure 4:
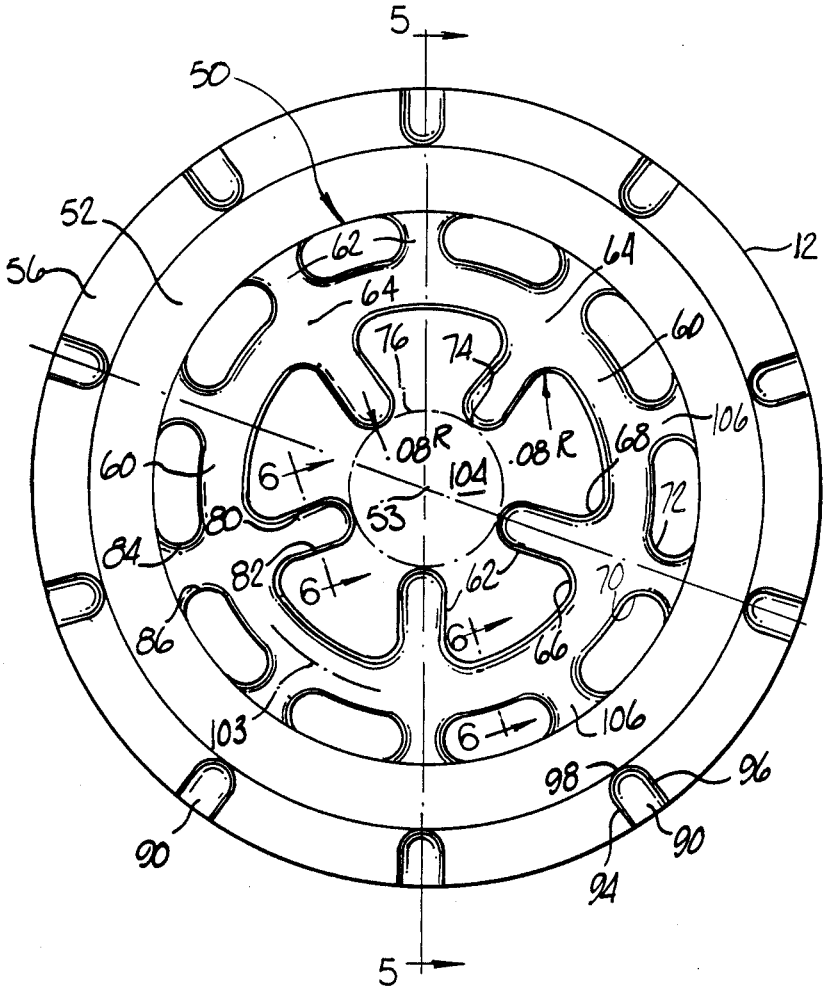
FIG. 4 is a bottom view of a can body member having an improved bottom wall structure.
Figure 5:
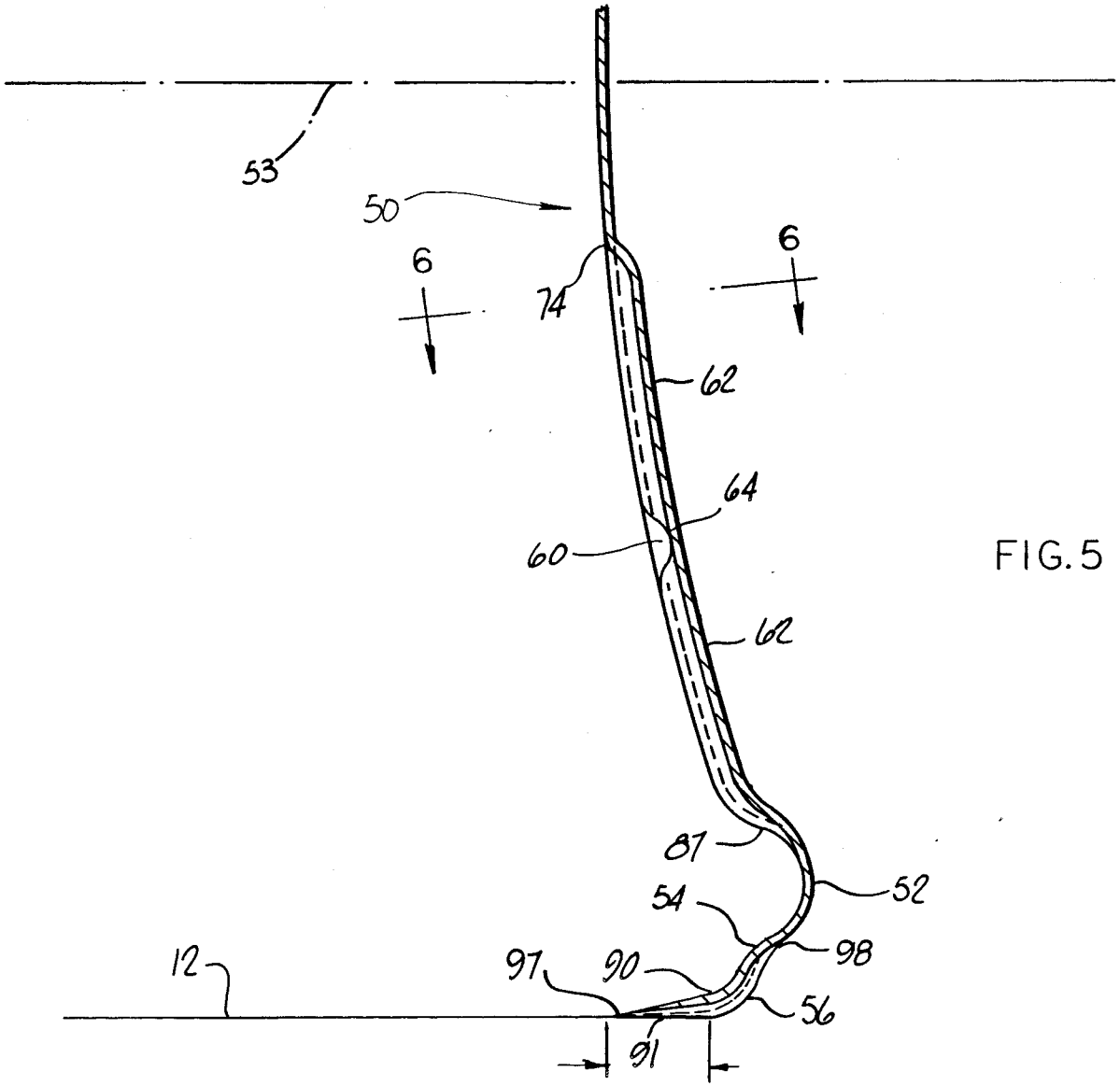
FIG. 5 is an enlarged cross-sectional view of a portion of the bottom wall structure of FIG. 4.
Figure 6:
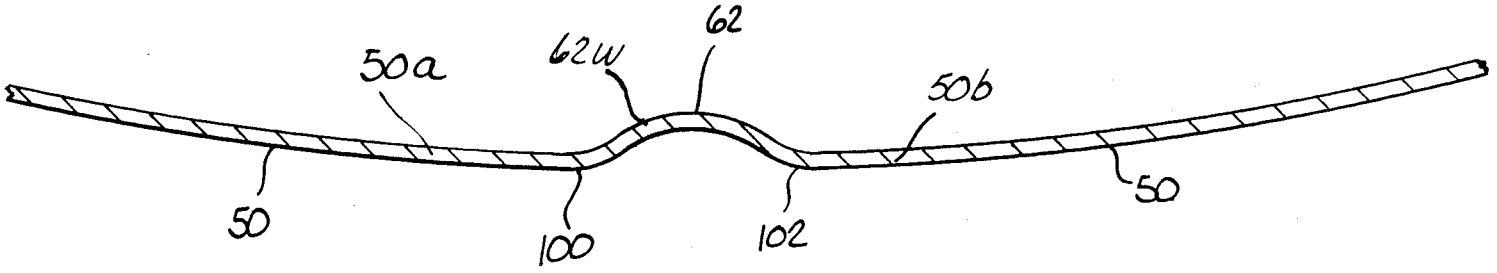
FIG. 6 is an enlarged cross-sectional view of a radial rib portion of the bottom wall structure of FIG. 5.
Figure 7:
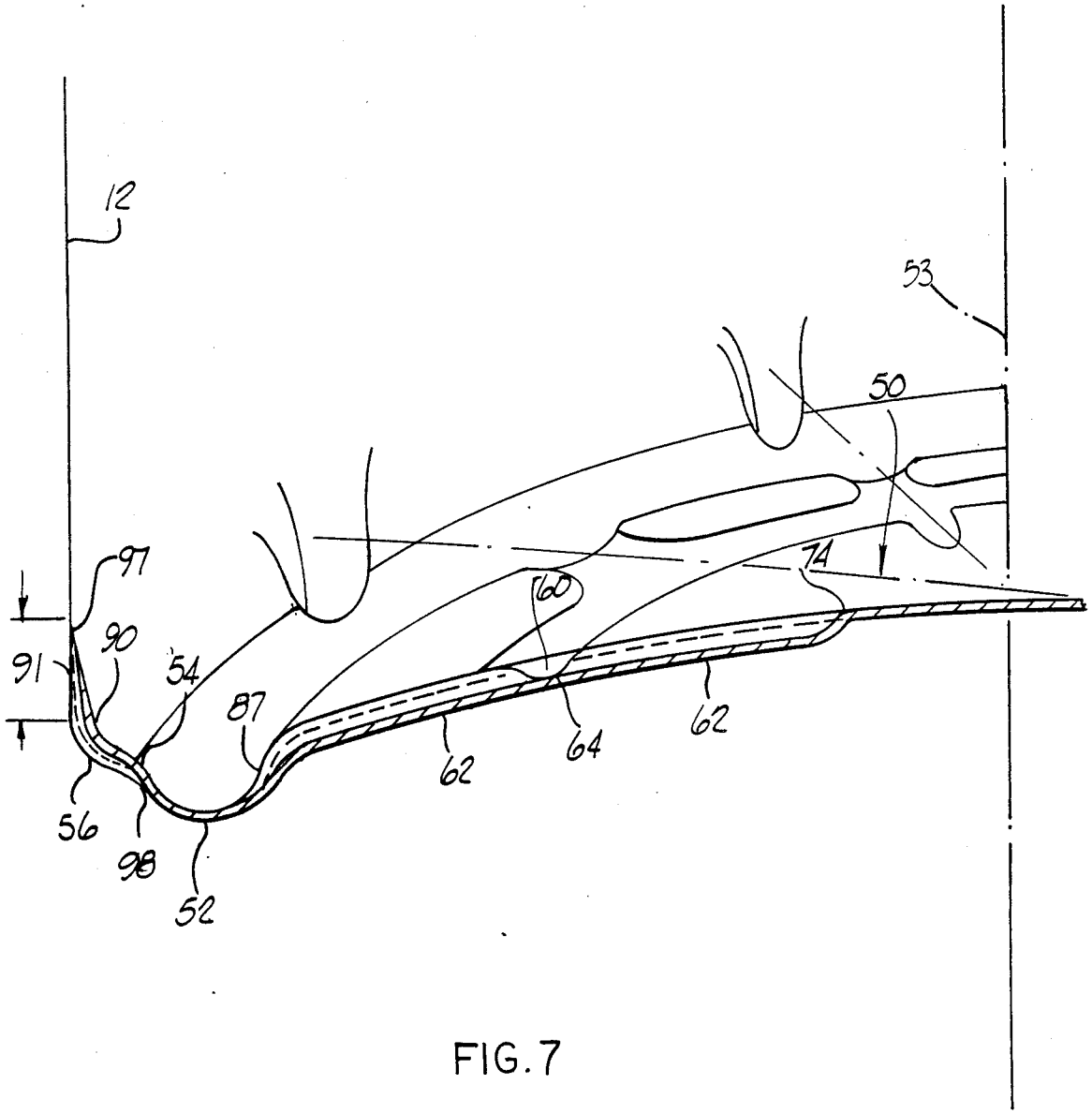
FIG. 7 is a perspective view of a quarter portion of the bottom of the can body depicted in FIGS. 4 and 5.

FIGS. 4–6 show a new domed can bottom construction which may be used separately or in conjunction with the can side wall construction shown in FIGS. 1–3. The can bottom construction comprises an axially inwardly extending concave domed center bottom wall portion 50, an annular axially outwardly extending convex bottommost support rib portion 52, and an inwardly extending concave annular rib portion 54 connected to side wall portion 12 by an outer annular curved connecting portion 56.

The domed central bottom wall portion 50 comprises an annular convex groove-rib portion 60 and a plurality of circumferentially spaced radially extending convex groove-rib portions 62 which intersect the annular convex groove-rib portion at intersection areas 64. Annular groove-rib portion 60 is concentric with the domed central wall portion 50 and support rib portion 52 and central axis 53. In the presently preferred embodiment, the annular convex groove-rib portion 60 and the radially extending convex groove-rib portions 64 have the same cross-sectional size, shape, width and depth and are connected at the intersections 64 by curved side surfaces 66, 68, 70, 72 having a radius of curvature of approximately 0.08 inch. The radially extending groove-rib portions 62 have the same radial length and cross-sectional size and shape and have curved radially innermost end portions 74 with relatively large radius of curvature of approximately 0.08 inch and located along a circle 76 concentric with and radially outwardly spaced from central axis 53. Each radial groove-rib portion has a pair of straight spaced parallel side wall portions 80, 82 extending between curved portions 66, 68 and curved portion 74. Each radial groove-rib portion also has curved (0.08 inch radius) radially outermost end portions 84, 86 located adjacent annular support rib portion 52.

As shown in FIG. 5, the radially outermost portions 87 of each radial groove-rib portion 62 extend into and merge with the support rib portion 52. In the presently preferred embodiment, radial groove-rib portions 62 and annular groove-rib portion 60 are axially offset from central domed-wall portion 50 and have a depth of approximately 0.025 inch which is greater than the bottom wall thickness of approximately 0.010 to 0.012 inch; and have a width of approximately 0.16 inch. Each groove-rib portion 60 and 62 have convexly curved wall portions of relatively large radius of curvature of approximately 0.075 inch and reversely curved connecting wall portions 100, 102, FIG. 6, of relatively large radius of curvature of approximately 0.05 inch. Each of the radial groove-rib portions 62 have a radial length of approximately 70 to 74% of the radial distance from support rib portion 52 to central axis 53 and terminate along the circle 76 so as to leave a non-ribbed central wall portion 104 within the circle 76. The groove-rib portion 60 is centered on a circular axis 103, FIG. 4, located approximately 70 to 74% of the radial distance from central axis 53 to support rib portion 52 so as to be located relatively closely circumjacent support rib portion 52. In the presently preferred embodiment, there are five equally circumferentially spaced radially extending groove-rib portions 62.

In addition, there are a plurality of equally circumferentially spaced radially extending relatively short length groove-rib portions 106 located between longer length groove-rib portions 62. Short-length groove-rib portions 106 extend between annular groove-rib portion 60 and support rib portion 52 and have the same cross-sectional shape and width and depth as longer-length groove-rib portions 62. For some types of can bottom construction, the radially extending groove-rib portions 62 may be used without the annular groove-rib portion 60.

In the presently preferred embodiment, the bottom wall portion further comprises a plurality of circumferentially spaced concave groove-rib portions 90 located in annular connecting wall portions 54, 56 and side wall portion 91 (FIG. 5) and extending axially and radially therealong. Each concave groove-rib portion 90 has straight parallel spaced side portions 94, 96, FIG. 4, and curved end portions 97, 98 which merge with side wall portion 91 and annular rib portion 52, as shown in FIG. 5. The concave groove-rib portions 90 are preferably radially aligned with and have the same cross-sectional shape and width and depth as radial groove-rib portions 62, 106 in the domed wall portion 50.

The groove-rib portions 60, 62, 90 will have approximately the same thickness as the adjacent wall portions, have a depth of approximately 0.025 inch, and have relatively large radius reversely curved connecting surfaces 100, 102, FIG. 6. It is contemplated that the radial rib portions 90 may be replaced by a concave annular rib portion in wall portion 54.

The axially outwardly extending convex radial groove-rib portions 62, 106 in the dome portion 50 enable reduction of metal thickness while maintaining required strength in the dome area. The circumferential groove-rib portion 62 in the dome portion 50 further enhances strength provided by the radial groove-rib portions to enable use of a shallower-depth dome which increases can volume and enables use of a shorter length can to further reduce material cost. The groove-rib portions 90 in the connecting wall area 54 provide increased strength between the side wall portion 91 and the support rib portion 52 to prevent deformation and rupture in a reduced-thickness connecting wall area 54 which may otherwise be weaker than the dome area.

It is contemplated that the use of the groove-rib means of the present invention will enable material cost savings of as much as 11%, as compared with current dome bottom can designs, resulting from use of thinner gauge sheet material such as 0.010 or 0.011 thickness, reduction in dome depth from approximately 0.38 inch to approximate inch, and reduction in can height from approximately 4.88 inch to approximately 4.80 inch.

Thus, the present invention provides a one-piece metallic can body member 10 comprising a cylindrical relatively thin side wall portion 12; an open end rim portion 16; and a dome-shape bottom wall portion 14. Bottom wall portion 14 has a concave dome-shape central portion 50, a convex axially outwardly extending lowermost annular support rib portion 52 connected to the dome-shape central portion, and a radially outermost inclined connecting wall portion 54 extending between the side wall portion 12 and the lowermost annular support rib portion 52. A plurality of circumferentially spaced radially inwardly extending convex groove-rib portions 62 are located in the concave dome-shape central portion 50 and extend radially inwardly from the lowermost annular support rib portion 52. An annular convex groove-rib portion 60 is located in the concave dome-shape central portion 50 and intersects the radially inwardly extending convex groove-rib portions 62 at area 64. A plurality of circumferentially spaced radially and axially extending concave groove-rib portions 90 may be provided in the radially outermost inclined connecting wall portion 54 and extend between the lowermost annular support rib portion 52 and the side wall portion 12 as shown in FIGS. 4 and 5.

The radially inwardly extending convex groove-rib portions 62 are equally circumferentially spaced and of equal size and shape and cross-sectional configuration as shown in FIGS. 4, 5 and 6. Each of the radially inwardly extending convex groove-rib portions 62 has a radially innermost end portion 74 located in radially outwardly spaced relationship to the central axis 53 of the can body member; and a radially outermost end portion 87, FIGS 4 and 5, which is located in and merges with the lowermost annular support rib portion 52.

The radially inwardly extending convex groove-rib portions 62 further comprise a curved convex central wall portion **62*w*, FIG. 6; and a pair of reversely curved connecting wall portions 100, 102 extending between the curved convex central wall portion 62*w* and adjacent dome-shape central wall portions 50*a* and 50*b*. As shown in FIG. 6, the radially inwardly extending convex groove-rib portions 62 have a depth greater than the thickness of the dome-shape central wall portion 50. The curved convex central wall portion 62*w* and the pair of reversely curved connecting wall portions 100, 102 have a relatively large radius of curvature (e.g., 0.075 and 0.05 inch respectively) substantially greater than the wall thickness (e.g., 0.010 to 0.012** inch).

The radially inwardly extending convex groove-rib portions 62 in the dome-shape central wall portion 50 and the concave groove-rib portions 90 in the inclined connecting wall portion 56 are radially aligned, as shown in FIG. 4; and have the same cross-sectional size and shape as shown in FIG. 6. The concave groove-rib portions 90 in the inclined connecting wall portion 56 have one end portion 97, FIG. 5, in and merging with the side wall portion 12, and another end portion 98 in and merging with the annular support rib portion 52.

While illustrative and presently preferred embodiments and combinations of groove-rib structure have been specifically shown and described herein, the inventive concepts may be otherwise variously employed and it is intended that the appended claims be construed to cover alternative embodiments except insofar as limited by the prior art.

What is claimed is:

1. A drawn and ironed one-piece metallic aluminum can body member for beverages such as beer and soft drinks comprising:

a cylindrical relatively thin side wall portion;

a rigid dome-shape bottom wall portion;

an open end rim portion; and stiffening means in said side wall portion for resisting deformation of said side wall portion by internal pressure, said stiffening means comprising:

a pair of axially spaced radially inwardly extending concave annular groove-rib portions of curved cross-sectional shape in said side wall portion, one of said concave annular groove-rib portions being located axially adjacent said rim portion and another one of said concave annular groove-rib portions being located axially adjacent said bottom wall portion; and a plurality of circumferentially spaced parallel radially inwardly extending concave axial groove-rib portions in said side wall portion of curved cross-sectional shape and extending axially between said pair of concave annular groove-rib portions; said dome-shape bottom wall portion comprising:

a radially innermost concave dome-shape central portion;

a convex axially outwardly extending lowermost annular support rib portion connected to said dome-shape central portion; and a radially outermost inclined connecting wall portion extending between said side wall portion and said lowermost annular support rib portion;

a plurality of circumferentially spaced radially inwardly extending convex groove-rib portions in said concave dome-shape central portion and extending radially inwardly from said lowermost annular support rib portion; and a plurality of circumferentially spaced radially and axially extending concave groove-rib portions in said radially outermost inclined connecting wall portion and extending between said lowermost annular support rib portion and said side wall portion.

2. The invention as defined in claim 1 and wherein said dome-shape bottom wall portion further comprising:

an annular convex groove-rib portion located in said concave dome-shape central portion and intersecting said radially inwardly extending convex groove-rib portions.

3. A one-piece drawn and ironed aluminum can body member for beverages such as beer and soft drinks and made from one piece of drawn and ironed aluminum sheet material and comprising:

a cylindrical relatively thin side wall portion with a central longitudinal axis;

an open end rim portion;

an annular bottom wall portion having an annular concave dome-shape central portion extending radially outwardly from said central longitudinal axis and terminating in an annular peripheral portion, a convex axially outwardly extending lowermost annular support rib portion connected to said annular peripheral portion of said dome-shape central portion, and a radially outermost annular inclined connecting wall portion extending between said side wall portion and said lowermost annular support rib portion;

a plurality of circumferentially spaced radially inwardly extending convex groove-rib portions formed in said concave dome-shape central portion and extending radially inwardly from said lowermost annular support rib portion toward said central longitudinal axis for strengthening and stiffening of said concave dome-shape central portion against deflection by internal pressure forces, each of said radial groove-rib portions having a radially innermost end portion which terminates in radially outwardly spaced relationship to said central longitudinal axis to provide an unribbed smooth surface centermost section of said concave dome-shaped central portion; and an annular convex groove-rib portion formed in said concave dome-shape central portion and being radially inwardly spaced from said lowermost annular support rib portion and intersecting a mid-portion of each of said radially inwardly extending convex groove-rib portions for further strengthening and stiffening of said concave dome-shape central portion.

4. The invention as defined in claim 3 and wherein:

said radially innermost end portion being curved upwardly toward and connected to and gradually merging into said unribbed smooth surface centermost section of said concave dome-shaped central portion and having only relatively large radius curved surfaces.

5. The invention as defined in claim 4 and wherein each of said radially inwardly extending convex groove-rib portions further comprises:

a radially outermost end portion which is located in and merges with said lowermost annular support rib portion.

6. The invention as defined in claim 5 and wherein each of said radially inwardly extending convex groove-rib portions have the same size and shape and are equally circumferentially spaced from one another.

7. The invention as defined in claim 4 or 6 and wherein:

said radially innermost curved end portions terminating equal radial distances outwardly of said central longitudinal axis; and said unribbed smooth surface centermost section having a generally circular periphery.

8. The invention as defined in claim 3 or 6 and wherein:

said annular convex groove-rib portion intersecting each of said radially inwardly extending convex groove-rib portions at an area of intersection located radially outwardly from the central longitudinal axis more than one-half the radial distance from the central longitudinal axis to said annular support rib portion.

9. The invention as defined in claim 8 and wherein:

each area of intersection being of equal size and shape and comprising curved connecting edge portions which are tangent to and extend between the side edge portions of said annular convex groove-rib portion and the side edge portions of said radially extending convex groove-rib portion.

10. The invention as defined in claim 4 and wherein:

each of said radially inwardly extending convex groove-rib portions having a radial length which is approximately 70 to 74% of the radial distance from said lowermost annular support rib portion to said central longitudinal axis.

11. The invention as defined in claims 3, 4 or 10 and wherein:

said concave dome-shape central portion having a thickness of no more than approximately between 0.010 to 0.012 inch.

12. The invention as defined in claim 11 and wherein:

each of said radially inwardly extending convex groove-rib portions being laterally displaced relative to said concave dome-shape central portion a distance or approximately twice the wall thickness of said concave dome-shape central portion.

13. The invention as defined in claim 11 and wherein:

said radially inwardly extending convex groove-rib portions having a width of approximately 0.16 inch.

14. The invention as defined in claim 11 and wherein each of said radially inwardly extending convex groove-rib portions having a width of approximately 0.16 inch and a depth of approximately 0.025 inch.

15. The invention as defined in claims 3 or 4 and wherein said can body member having a maximum wall thickness of no more than approximately 0.012 to 0.012 inch.

16. The invention as defined in claim 3 and wherein:

said bottom wall portion having a thickness of approximately 0.010 to 0.012 inch.

17. The invention as defined in claims 4 or 16 and wherein:

said radially inwardly extending convex groove-rib portions having circumferentially spaced unribbed domed wall segments of equal size and shape therebetween which have a generally trapezoidal peripheral configuration and are connected to said unribbed smooth surface centermost section by spaced unribbed intermediate domed wall segments located between each of said radially innermost end portions of said radially inwardly extending convex groove-rib portions.

18. The invention as defined in claim 17 and further comprising:

a plurality of circumferentially spaced radially extending relatively short length groove-rib portions being located between circumferentially adjacent ones of said radially inwardly extending convex groove-rib portions and extending radially between said annular support rib portion and said annular groove-rib portion.

19. The invention as defined in claim 18 and wherein:

said relatively short length groove-rib portions being equally circumferentially spaced and located midway between said adjacent ones of radially inwardly extending convex groove-rib portions.

20. The invention as defined in claim 19 and further comprising:

a plurality of circumferentially spaced radially outermost groove-rib portions in said inclined connecting wall portion for reinforcement thereof.

21. The invention as defined in claim 20 and wherein:

said radially outermost groove-rib portions being equally circumferentially spaced and radially aligned with said long length radial groove-rib portions.

22. The invention as defined in claim 17 and wherein all said groove-rib portions in said domed center wall portion are of equal depth and width.

23. The invention as defined in claim 22 and wherein said depth is approximately 0.025 inch.

24. The invention as defined in claim 23 and wherein said width is approximately 0.16 inch.

25. The invention as defined in claim 24 and wherein the side edges of all groove-rib and all land segments therebetween are connected by arcuate end surfaces having a radius of approximately 0.08 inch.

26. The invention as defined in claim 3 and wherein each of said radially inwardly extending convex groove-rib portions have a shallow depth and are laterally displaced relative to adjoining smooth surface portions of said concave dome-shape central portion a distance of no more than twice the wall thickness thereof.

27. The invention as defined in claim 26 and wherein:

each of said radially inwardly extending convex groove-rib portions have straight spaced parallel side edge portions extending between said curved radially innermost end portion and said radially outermost end portion.

28. A one-piece metallic can body member comprising:

a cylindrical relatively thin side wall portion;

an open end rim portion;

a dome-shape bottom wall portion having a concave dome-shape central portion, a convex axially outwardly extending lowermost annular support rib portion connected to said dome-shape central portion, and a radially outermost inclined connecting wall portion extending between said side wall portion and said lowermost annular support rib portion;

a plurality of circumferentially spaced radially inwardly extending convex groove-rib portions in said concave dome-shape central portion and extending radially inwardly from said lowermost annular support rib portion;

an annular convex groove-rib portion located in said concave dome-shape central portion and intersecting said radially inwardly extending convex groove-rib portions; and a plurality of circumferentially spaced radially and axially extending concave groove-rib portions in said radially outermost inclined connecting wall portion and extending between said lowermost annular support rib portion and said side wall portion for strengthening and stiffening said inclined connecting wall portion.

29. The invention as defined in claims 3 or 28 and wherein:

said radially inwardly extending convex groove-rib portions ar equally circumferentially spaced and of equal size and shape and cross-sectional configuration.

30. The invention as defined in claim 29 and wherein:

each of said radially inwardly extending convex groove-rib portions have a radially outermost end portion which is located in and merges with said lowermost annular support rib portion.

31. The invention as defined in claim 30 and wherein each of said radially inwardly extending convex groove-rib portions having a transverse cross-sectional configuration defined by:

a curved convex central wall portion; and a pair of reversely curved connecting wall portions extending between said curved convex central wall portion and adjacent dome-shape central wall portions.

32. The invention as defined in claim 31 and wherein:

each of said radially inwardly extending convex groove-rib portions have a depth greater than the thickness of the dome-shape central wall portion; and said curved convex central wall portion and said pair of reversely curved connecting wall portions of said radially inwardly extending convex groove-rib portions having a relatively large radius of curvature substantially greater than the wall thickness.

33. The invention as defined in claim 28 and wherein:

at least some of said radially inwardly extending convex groove-rib portions in said dome-shape central wall portion and said concave groove-rib portions in said inclined connecting wall portion are radially aligned.

34. The invention as defined in claim 33 and wherein:

said radially inwardly extending convex groove-rib portions in said dome-shape central wall portion and said concave groove-rib portions in said inclined connecting wall portion have the same cross-sectional size and shape.

35. The invention as defined in claims 28 or 34 and wherein:

said concave groove-rib portion in said inclined connecting wall portion have one end portion in and merging with said side wall portion, and another end portion in and merging with said annular support rib portion.

36. The invention as defined in claim 28 and further comprising:

a pair of axially spaced radially inwardly extending concave annular groove-rib portions in said side wall portion, one of said concave annular groove-rib portions being located axially adjacent said rim portion and another one of said concave annular groove-rib portions being located axially adjacent said bottom wall portion; and a plurality of circumferentially spaced parallel radially inwardly extending concave axial groove-rib portions in said side wall portion and extending axially between said pair of concave annular groove-rib portions.

* * * * *